US008376592B2

(12) United States Patent
Engstrom et al.

(10) Patent No.: US 8,376,592 B2
(45) Date of Patent: Feb. 19, 2013

(54) RECESSED-LIGHT CONVERSION APPARATUS, SYSTEM, AND METHODS

(75) Inventors: Cheryl Engstrom, Bothell, WA (US); Donn Jeffrey Engstrom, Bothell, WA (US); Scott Patrick Bell, Nampa, ID (US)

(73) Assignee: Burnes Brighter Ideas, LLC, Atlanta, GA (US)

( * ) Notice: Subject to any disclaimer, the term of this patent is extended or adjusted under 35 U.S.C. 154(b) by 38 days.

(21) Appl. No.: 12/890,410

(22) Filed: Sep. 24, 2010

(65) Prior Publication Data

US 2011/0141741 A1 Jun. 16, 2011

Related U.S. Application Data

(60) Provisional application No. 61/286,901, filed on Dec. 16, 2009.

(51) Int. Cl.
*F21V 17/00* (2006.01)

(52) U.S. Cl. ..... 362/364; 362/365; 362/404

(58) Field of Classification Search ..... 362/364–366, 362/147, 148

See application file for complete search history.

(56) References Cited

U.S. PATENT DOCUMENTS 2,491,376 A * 12/1949 Hartman ..... 362/438
4,516,678 A * 5/1985 Fotiadis et al. ..... 206/308.3
4,636,926 A * 1/1987 Roberge ..... 362/353

OTHER PUBLICATIONS

U.S. Appl. No. 61/286,901, filed Dec. 16, 2009, Calder et al.
Brochure titled: Stonegate Designs Light Enhancing Life Can Shades from Stonegate Designs; available from Stonegate Designs, Inc., located in St. Josephs, Michigan 1 page.
International Search Report and Written Opinion for Int'l Patent App. No. PCT/US2010/059731; Feb. 11, 2011 (10 pgs).

* cited by examiner

*Primary Examiner* — Ali Alavi
(74) *Attorney, Agent, or Firm* — Husch Blackwell LLP

(57) ABSTRACT

Exposed fixture means and associated mounting features constituting a broad range of structural, aesthetic, and/or functional enhancements to existing recessed fixtures. Embodiments are generally configured to couple at a structural surface at and/or surrounding a recessed fixture. A mounting ring provides secure attachment at the structural surface, a ring cover typically engages with the mounting ring in a twist-lock engagement. An exposed fixture means (EFM) may be coupled at a side of the ring cover opposite the mounting ring. A system of correspondingly configured latch members of each of the ring cover and mounting ring enables relatively universal coupling of different EFMs at an already installed mounting ring. EFMs include a wide variety of aesthetic, functional, and/or structural embodiments.

20 Claims, 7 Drawing Sheets

RECESSED-LIGHT CONVERSION APPARATUS, SYSTEM, AND METHODS

RELATED APPLICATIONS

This application claims the benefit of priority to pending U.S. Provisional Patent Application No. 61/286,901, filed on Dec. 16, 2009 and entitled SHADE ATTACHMENT DEVICE FOR RECESSED LIGHTS.

FIELD OF THE INVENTION

The invention relates generally to the field of lighting fixtures, and more particularly, the invention relates to an exposed fixture apparatus, system, and method for affecting one or more of the aesthetic, functional, and/or performance characteristics of an already installed recessed fixture.

BACKGROUND OF THE INVENTION

Recessed fixtures (e.g., recessed light fixtures, etc.) are commonly used in both residential and commercial settings, and may be either originally installed during construction, or subsequently added during a remodel. Typically, the structure of a recessed fixture is mostly or entirely recessed into a structural surface (e.g., a ceiling, wall, etc.), leaving little if any structure extending beyond a nominal plane of the structural surface immediately surrounding the recessed fixture.

Users wishing to convert a recessed light to an exposed fixture—by adding a glass shade for example—have few available options without replacing or modifying the fixture itself. Further, altering existing recessed fixtures typically requires employing an electrician, a carpenter or other qualified craftsmen due to safety considerations and/or due to the specific skills and/or tools reasonably required.

Available devices generally require attachment to the recessed light fixture itself. For example, some shades (e.g., from Stonegate Designs; 4200 Niles Road, St. Joseph, Mich. 49085; www.stonegatedesigns.com) clip to the trim piece of an existing recessed 'can light' fixture. However, such recessed light fixtures are not designed and configured to support the additional weight of, for example, a glass and/or metal shade or another structure with which a user may wish to update an interior space. While recessed fixtures originally installed during construction are more solidly attached than recessed fixtures later installed during a remodel, for example, recessed fixtures are not generally intended to be load-bearing, or to provide structural attachment and/or support for other structures.

For at least this reason, available devices are limited only to attachment of lightweight aesthetic covers (e.g., shades) to a recessed light, wherein the recessed light itself remains the source of any provided light. Therefore, the available range of improvements is generally limited to a narrow range of lightweight aesthetic alterations alone.

BRIEF DESCRIPTION. OF THE DRAWINGS

DETAILED DESCRIPTION OF THE PREFERRED EMBODIMENTS

Figure 1:
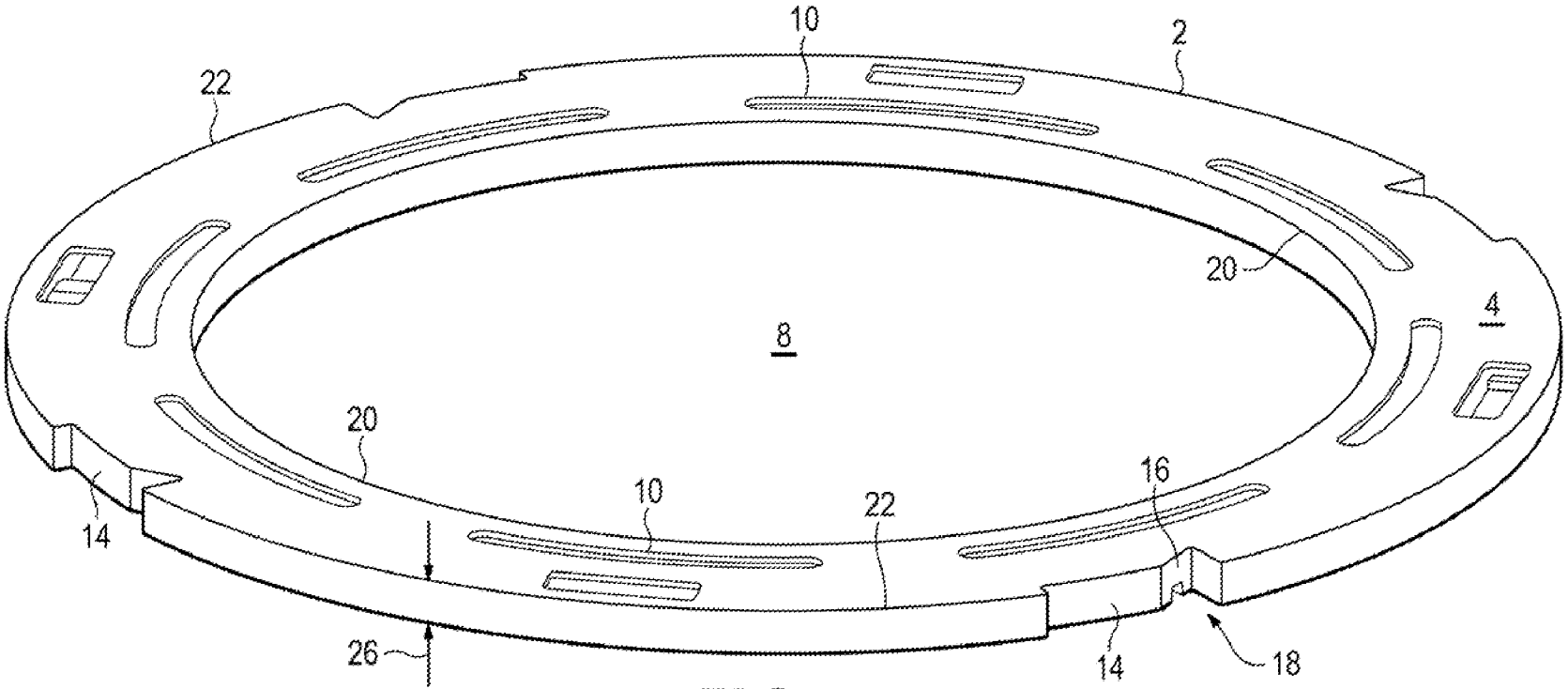
FIG. 1 is a perspective view depicting a first side of a mounting ring according to an embodiment of the invention.

Described herein are numerous embodiments of the invention. The described and, depicted embodiments are for solely illustrative purposes, and are not intended to limited the broader scope of contemplated embodiments, nor to prevent the substitution of alternative structures, materials, arrangements, configurations, or equivalents that fall within the broader scope of the invention, as will be apparent to a person having ordinary skill in the art ('ordinarily skilled artisan').

The embodiments may be conceptually grouped into either or both of two general classes. A first class of embodiments generally includes arrangements of structural components configured to facilitate primarily aesthetic enhancements to fixtures and/or other features recessed into a surface (e.g., ceiling, wall, etc.). A second class of embodiments generally includes arrangements of structural components configured to additionally or alternatively facilitate functional and/or performance enhancements to recessed light fixtures and/or other types of recessed fixtures. Of course, numerous embodiments are expected to provide any combination of aesthetic, functional, and/or performance enhancements, and the embodiments are not considered mutually exclusive. Therefore, the two general classes described above are intended as a useful artifice for descriptive convenience only, and are not intended to limit the scope of the contemplated embodiments.

Overall, the scope of the invention encompasses all embodiments, without regard to the particular setting (e.g., residential, commercial, industrial, institutional, etc.) in which such embodiments may be used.

The contents of U.S. Provisional application No. 61/286,901 ('901), filed on Dec. 16, 2009, are hereby incorporated herein in their entirety by this reference for explanatory purposes only. Provisional application '901 describes an apparatus generally employable without the aid of a professional installer, enabling homeowners and others to easily update the appearance of recessed lights with an exposed shade.

Provisional application '901 describes an inner ring attachable to the surface of a ceiling immediately surrounding a recessed light. Attachment may be affected either by inserting screws through any of a plurality of small holes provided in the inner ring and securing the screws into the ceiling material, or by applying a suitable adhesive between the inner ring and the ceiling.

However, neither of these methods allows for rotational adjustment of the inner ring following attachment to a structural surface without completely separating the ring from the surface and starting over. In the case of an adhesive, detachment may damage the ceiling, as well as perhaps requiring replacement of the inner ring.

'901 further describes an attaching flange that extends outwardly and/or downwardly from the inner ring, and which includes one of a limited number of identified alternative features to facilitate attaching an outer ring thereto. The outer ring fits over the inner ring and "attachment means" of the outer ring engage the provided alternative features. A specific shade is then attached to the outer ring using a fastening means, for example a screw post and a screw inserted through a screw hole. '901 describes the "attachment means" of the outer ring as "hooks or grooves", but does not expressly describe or depict the structure of any such 'hooks or grooves'.

It is recognized that claims to any invention may recite one or more elements found in the prior art. For example, a claim directed to an improved chair backrest may recite in part prior art elements such as a conventional chair seat and/or legs, to provide structural context. Reciting such prior art elements does not render the inventor(s) of those prior art elements co-inventor(s) of the claimed improvements. Therefore, the inventorship and scope of a claimed invention is directed toward and recognized for only the patentable advancements over the prior art.

The scope of the embodiments described, depicted, and/or claimed in this application is not directed to the contents of '901, but rather to improvements over and/or differences relative to '901. Likewise, the scope of the embodiments is not directed to the contents of any valid prior art document.

Nevertheless, the scope of the invention is otherwise hereby expressly intended to extend to the fullest range of embodiments and equivalents allowable.

INTERPRETATION OF TERMS AND DEFINITIONS

All terms defined in this specification, whether expressly or by implication, are intended to consistently and exclusively possess the meanings expressly set forth herein, unless otherwise specifically stated. If an undefined term used herein also possesses a plain and ordinary meaning in the art, that plain and ordinary meaning will apply unless otherwise stated herein. If a term and/or phrase defined herein consists of two or more words combined, the term/phrase shall be interpreted as an integrated whole. Any interpretation which separately construes each word of an integrated term/phrase used herein shall be considered inconsistent with this specification and therefore improper. Terms/phrases that are specifically defined herein shall be interpreted as indicated, whether or not one or more of the words in the term/phrase is capitalized.

Terms used to indicate a relative spatial location, position or orientation (e.g., higher, above, top, front, proximate, etc.) are used consistently herein in an illustrative sense, and are not intended to limit the scope of the embodiments to only the specific location, relationship or orientation described, unless otherwise indicated. Terms used to indicate a relative condition (e.g., relatively, substantially, approximately, etc.) are used consistently herein to indicate a non-absolute character. Such terms are nevertheless definite with reference to the context and content within which the term is used.

Where such terms appear in the claims, they are expressly intended to be interpreted with reference to and consistent with the specification and drawing figures, as such would be understood by an ordinarily skilled artisan.

Various structures are referred to herein as having first and second sides, or first and second ends. For descriptive convenience and clarity throughout, an illustrative convention is utilized wherein a 'first' side or end is typically that side or end that faces or most closely approaches a recessed fixture. The 'second' side or end, by contrast, typically faces away from and/or less closely approaches the recessed fixture—and/or extends into the recessed fixture to a lesser extent—than does the first end.

This illustrative convention is not intended, however, to suggest an order of priority or of time, to exclude any number of other ends, surfaces, or structures, and is not intended to otherwise limit the scope of the embodiments. The scope of contemplated embodiments extends well beyond the few illustrative embodiments described according to this convenient descriptive convention, as would be understood by an ordinarily skilled artisan.

Terms indicating permissive and/or possible actions (e.g., may, can, might, should, etc.) are intended herein to indicate that alternatives (e.g., actions, features, materials, dimensions, arrangements, etc.) are contemplated according to at least one embodiment of the invention. Such alternatives may include preferred embodiments, user-definable options, and/or other variations, and expand rather than limit the scope of the inventive embodiments. Therefore, such terms are not intended herein to convey indefiniteness, and shall not be interpreted as such.

Applicant recognizes that terms used in the claims may be interpreted in some settings according to their broadest reasonable interpretation. However, applicant hereby expressly intends that any 'reasonable' interpretation of claims originally presented herein and/or as later properly amended, must be consistent with the subject matter presented in this application and any equivalents thereof, as such would be understood by an ordinarily skilled artisan. An asserted interpretation that is inconsistent with and/or contradicts the descriptions, drawing figures and/or claims as originally filed, is not considered a reasonable interpretation, and is therefore improper. An alternative embodiment shall not be considered 'inconsistent' with the specification merely because that embodiment is not expressly described in the specification.

Each of the following terms and/or phrases shall have the meaning(s) provided in this specification, whether expressly or implicitly in view of and consistent with a provided description and/or drawing figures thereof, which meaning shall supersede any existing, inconsistent plain meaning in the art:

Mounting ring
Ring cover
Exposed Fixture Means (EFM)
Indexing fastener
Pendant fixture
Electrical source
Recessed fixture conversion apparatus (or system, or method)

Exemplary units of measurement expressed herein are generally used to illustrate a particular embodiment or range of embodiments, and should not otherwise be interpreted to limit the scope of embodiments, or to preclude configuring an embodiment according to an alternative measurement system (e.g., metric). In the claims, terms expressed in the singular likewise includes the plural.

For descriptive convenience and clarity alone, this description is divided into several sections. Neither the divisions themselves nor the section titles are intended to limit the scope of the invented embodiments, or to imply a divisibility of the embodiments or the described features other than to the extent such would be recognized by an ordinarily skilled artisan in view of the description, drawing figures, and claims provided herein.

Mounting Ring

Figure 2:
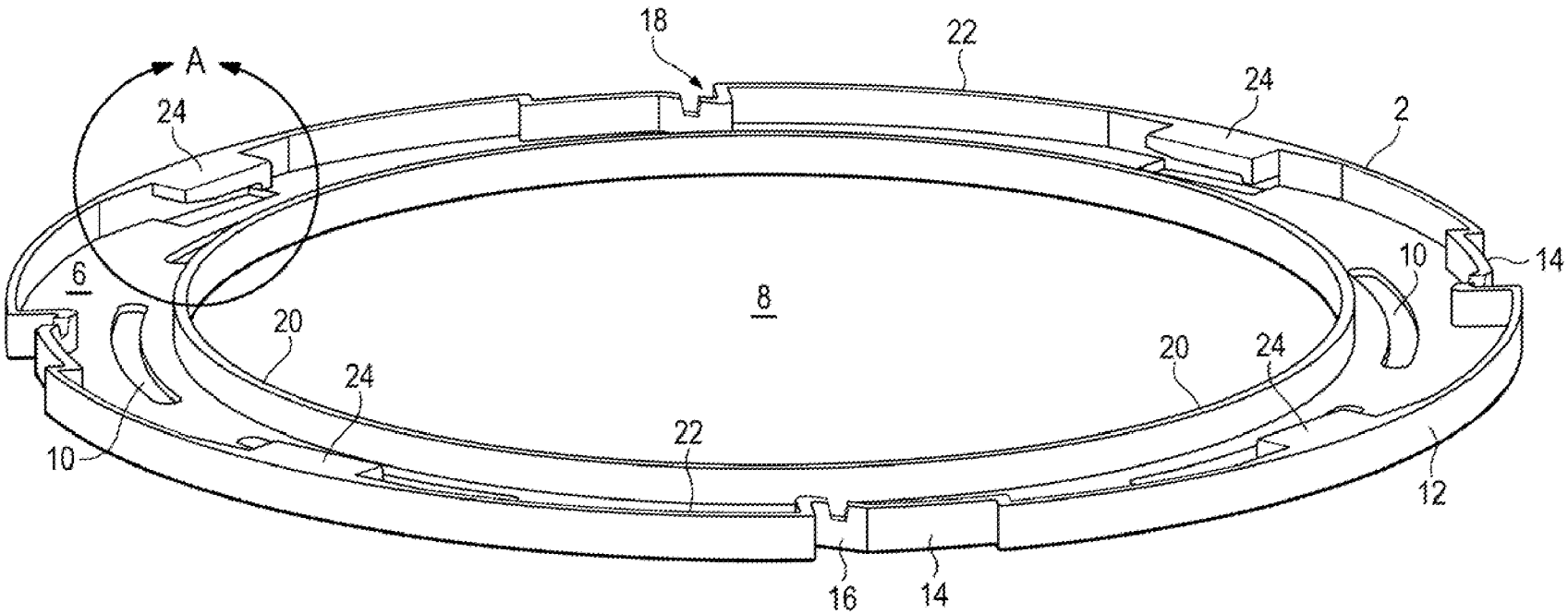
FIG. 2 is a perspective view depicting a second side of a mounting ring according to an embodiment of the invention.

Turning now to the drawings, FIGS. 1 and 2 depict a substantially planar mounting ring 2 having a first side 4 and an opposing second side 6, according to a typical but not exclusive embodiment. The qualifying term 'substantially planar' herein contemplates that a mounting ring 2 can include various surface features (e.g., projections, recesses, etc.) at a surface of either the first side 4 or the second side 6 in one or more embodiment. Nevertheless, one or both of the first side 4 and the second side 6, or the overall structure of the mounting ring 2, generally lies along a conceptual plane.

Among other benefits, such planar configuration facilitates a close interface between a mounting ring 2 and a generally planar surface of a structure (e.g., ceiling, wall, floor, etc.) to which a mounting ring 2 may be attached. As will be described in further detail herein, a planar mounting ring configuration also provides for a close and convenient attachment between a mounting ring 2 and a corresponding ring cover 52 (see FIG. 3).

In at least one alternative embodiment, however, a portion of a mounting ring 2 (e.g., a relative center thereof) may deviate from a plane, whether concavely, convexly or both, while another portion of the mounting ring (e.g., beyond a relative center thereof) lies along a conceptual plane. For example, one such alternative embodiment may resemble a hat, with a central dome (or other configuration) and a relatively planar peripheral 'brim', wherein the brim facilitates coupling the mounting ring with a corresponding ring cover.

A mounting ring 2 is typically relatively rigid, enabling the mounting ring to withstand an applied load for an extended period of time without responsively deforming to any substantial degree. For example, a mounting ring may be formed of a cast and/or milled metal (e.g., die cast aluminum, steel, etc) or metallic alloy, a ceramic, a relatively rigid polymer (e.g., polycarbonate, etc.), or another suitable material or suitable combination of two or more materials.

Depending upon the particular characteristics of a utilized material, one or more dimensions (e.g., thickness, width, etc.) of a mounting ring 2 can be increased or decreased as compared to other materials, to provide a suitable rigidity for an intended application (e.g., considering load, mounting orientation, etc.). Alternatively and/or additionally, ribs, gussets, and/or other reinforcing structures as known in the art can be provided, and/or additional fastener holes 10 may be provided and utilized, to enhance the load capacity of a mounting ring.

Alternatively or additionally, an interior metal or other relatively durable (e.g., rigid, etc.) structure may be coated, laminated, or otherwise combined with a relatively less durable/rigid material configured as an outer sheath, for example.

Depending on a particular application, a mounting ring can be stamped and formed from a sheet material (e.g., metal), thermoformed, chemically etched, laser cut, molded and/or formed by any other suitable method or combination of methods with respect to a particular material or combination of materials used.

The several dimensions (e.g., width, thickness, etc.) of a mounting ring 2 can vary substantially according to alternative embodiments. For example, the diameter of a round mounting ring can vary from only few centimeters in one embodiment, to a meter or more in another embodiment. Likewise, a thickness 26 of a mounting ring (e.g., between the first side 4 and the second side 6 thereof) can vary from only a few millimeters in one embodiment to tens of centimeters or more in another. Factors affecting selection of a mounting ring 2 having any particularly combination of dimensions may include the dimension(s) and/or type of a recessed fixture with which the mounting ring will be used, the dimension(s) (including the weight) of an exposed fixture means to be used with the mounting ring, the materials from which the mounting ring 2 will be formed, and/or other considerations.

A mounting ring 2 generally but not exclusively possesses a primarily circular outer periphery 22 according to a preferred embodiment, as substantially depicted in FIGS. 1 and 2. However, embodiments having a non-circular (e.g., piecewise linear or complexly curved, square, triangular, pentagonal, hexagonal, octagonal, etc.) outer periphery 22 are also contemplated herein, and such embodiments will generally also be structurally configured to enable a "twist-lock" engagement of a ring cover 52 with the mounting ring 2.

A mounting ring 2 typically includes a central opening 8 disposed through its relative center from the first side 4 to the second side 6 thereof. Various dimensions of a central opening 8 can vary according to alternative embodiments. For example, a central opening 8 can be less than one millimeter in diameter (e.g., allowing passage of only a single 'live' electrical wire), or it can be many inches in diameter (e.g., enabling light from a large recessed fixture to pass relatively unimpeded), according to different embodiments.

Likewise, a passage length of the central opening 8 between a first side 4 and a second side 6 of a mounting ring 2 can either correspond to or vary from a nominal thickness of the mounting ring 2, where for example a mounting ring is either thicker or thinner at its center than at its outer periphery 22. An aspect ratio of the central opening 8, relating the passage diameter (a.k.a., 'width') to the passage length, is likewise variable according to alternative embodiments.

A central opening 8 can further vary in diameter according to an embodiment, either narrowing or widening as it passes through from a first side 4 to a second side 6 of the mounting ring 2. Likewise, a central opening 8 can be either narrower or wider at multiple points intermediate the first side 4 and the second side 6. For example, a central opening 8 may include one or more sequential ridges or threads provided at a surface of the passage of the central opening 8, although the embodiments are not so limited. The benefits of such features will be apparent to an ordinarily skilled artisan in light of further description provided below.

A central opening 8 may have a generally circular periphery 20 as shown in FIGS. 1 and 2, but the embodiments are not so limited. Just about any alternative periphery 20 shape is contemplated, whether symmetrical (e.g., square, octagonal, etc.) or asymmetrical. Accordingly, any one or more widthwise dimensions measured across a central opening 8 may correspond relatively closely to a width of an opening in a structural surface corresponding to a recessed fixture ('recessed fixture opening') about which the mounting ring is coupled, or may bear little or no relation to one or more dimensions of the recessed fixture opening.

To enable attachment of a mounting ring 2 at a structural surface, a mounting ring further typically includes one or more attachment means. Preferably, such attachment means enable positional adjustment of the mounting ring after initial attachment, as may facilitate changing an orientation or other aspect of the aesthetic presentation of a light fixture or other exposed fixture means coupled with the mounting ring.

However, one or more embodiments also contemplate a relatively fixed attachment of a mounting ring 2 to a structure surface. For example, an adhesive can be disposed at the first surface 4 of a mounting ring 2, either as a liquid, gel, paste, adhesive gasket, or other form now known or later developed in the art. A suitable adhesive would generally be selected to provide a strong, durable adhesion between a structural surface and the mounting ring.

Preferably, however, a mounting ring will be configured for attachment at a structural surface by the use of one or more fasteners. Examples of suitable fasteners include but are not limited to screws, expansion anchors, bolts, clips, pins, snapfit features, etc. Preferably, a suitable fastener can be repeatedly released and secured, allowing positional adjustments of a mounting ring throughout its useful lifetime. However, less adjustable and/or non-adjustable fasteners (e.g., nails, spikes, rivets, staples, moly-bolts, etc.) may also be used according to the embodiments.

Preferably, a suitable fastener will extend through a mounting ring 2 and sufficiently beyond the structural surface to enable a secure attachment. Where the structural surface is a surface of a sheet material (e.g., gypsum board, wood paneling, sheet metal, etc.), the fastener will preferably extend beyond an opposing side of a sheet material and include a widened portion which engages a broader surface area at the opposing side of the sheet material.

For example, a so-called 'butterfly expansion anchor' collapses to insert through a relatively small hole in a sheet material. Once the collapsed portion of the anchor passes through the hole and beyond the opposite side of the sheet material, it expands to extend substantially beyond the relatively small diameter of the hole. Such anchors, and others as may be known or become known in the art, enhance the load bearing capacity of a mounting ring. In general, the load bearing capacity of a mounting ring so affixed will far surpass that of a structure coupled to a recessed fixture itself, or a tensile force within a hole therein.

Alternatively, one or more of the fasteners may extend through a structural sheet material and frictionally and/or threadingly engage a structural member (e.g., wooden or metal stud, beam, post, etc.) positioned at an opposing side of the sheet material. Where, however, the material of a structural surface (e.g., solid wood, metal, etc.) or immediately beyond the structural surface is sufficiently robust to prevent inadvertent detachment of a fastener in response to an ordinary and expected applied load or other stress, a fastener that simply engages with such material may likewise be sufficient.

Referring again to FIGS. 1 and 2, to accommodate fastening a mounting ring to a structural surface using one or more fasteners, one or more openings 10 ('fastener holes') are typically but not exclusively provided through the mounting ring from the first side 4 to the second side 6 thereof. The fastener holes 10 are typically but not exclusively provided beyond (e.g., outside) a periphery 20 of the central opening 8, but within and spaced apart from the outer periphery 22 of the mounting ring 2. Alternatively and/or additionally, fastener holes may be provided through one or more grommets extending either outwardly from the outer periphery 22 of the mounting ring 2, or inwardly from the periphery of the central opening thereof.

Positioning one or more fastener holes 10 between and relatively equidistant relative to each of the central opening 8 and the outer periphery 22, according to a preferred but non-exclusive embodiment, helps to distribute the stresses of a load applied to the mounting ring 2, reduce deformation of the ring, and provide a stable, secure attachment of the mounting ring 2 with a structural surface.

Plural fastener holes 10 may also be arranged relatively equidistantly from one another. In an illustrative embodiment, four fasteners holes 10 are provided through the mounting ring 2 at positions corresponding to, for example, the three o'clock, six o'clock, nine o'clock, and twelve o'clock positions of a clock face. However, equidistant spacing of fastener holes 10 is not required in all embodiments, and is not intended to limit the scope of the claims as defined in the claims, as appended or as later amended.

As shown in FIGS. 1 and 2, fastener holes 10 are preferably but not exclusively configured as elongated slots arranged in a relatively circumferential pattern beyond and about the periphery 20 of the central opening 8. Such slots enable adjustment of a rotational orientation of a mounting ring 2 even after coupling the mounting ring with a structural surface. Such flexibility provides substantial benefits during mounting as well as throughout the useful lifetime of a mounting ring.

For example, a user may couple a round light shade with a mounting ring initially, but later wish to change to a square shade. Slotted fastener holes 10 allow the user to loosen the fasteners, rotate the mounting ring relative to a structural surface to align the square shade to a wall or to align the sides of multiple square shades arranged in a row, for example, and to then re-tighten the fasteners. The user is not required to remove the mounting ring entirely from the structural surface, saving time and reducing difficulty.

The length and/or width of the one or more slotted fastener holes 10 can vary according to alternative embodiments, as can the quantity and/or positions of the fastener holes relative to each other and/or relative to the central opening 8 of the mounting ring 2, for example. In at least one embodiment, plural concentric rows of slotted fastener holes 10 may be provided, with each sequential row lying further beyond the central opening 8 than another row.

Typically a thickness of the mounting ring 2, a size(s) of one or more fastener holes 10, and/or a size of one or more utilized fasteners, will be configured to prevent the fastener(s) from being pulled through the fastener hole(s) in response to a load applied to the mounting ring. For example, alternative exposed fixture means useable with mounting ring may vary in weight from several tens of grams up to several tens of kilograms (e.g., 50 kilograms or more), for example. Therefore, a mounting ring, fastener holes, and fasteners can be configured to durably bear any load within an entire reasonably expected weight range.

Likewise, fasteners having a sufficient individual and/or collective tensile strength will typically be selected to avoid tensile failure in response to reasonably expected loads. In at least one embodiment, one or more clamps and/or clips (also considered fasteners herein) are configured to extend through the central opening 8, and to apply a compressive force to each of the second side 6 of the mounting ring and a surface of a structural sheet material on a side opposite that at which the mounting ring is attached. Such clips and/or clamps would generally be likewise releasable to facilitate post-installation adjustment of a mounting ring.

As depicted in FIG. 2, amounting ring may preferably comprise a relatively flat expanse, having one or more raised lips or rims ('rims') provided at either or both the outer periphery 22 of the mounting ring 2 and the periphery 20 of the central opening 8. The rim will typically extend perpendicularly from second side 6 of the mounting ring 2 relative to the expanse. In such embodiments, a second side 6 of the mounting ring 2 is typically configured with an open cavity defined by the expanse and the one or more rims.

Alternatively, a mounting ring 2 may be configured as a relatively solid 'plate' having a relatively uniform thickness across most or all of its expanse. Of course, various embodiments having configurations intermediate these two are also contemplated, such as where an expanse having a relatively uniform thickness includes one or more 'cavities' provided at either or both of its first and second sides (4/6), however formed and/or specifically configured.

In whatever configuration, (e.g., plate, flattened expanse or other), a preferred but non-exclusive embodiment of a mounting ring 2 will typically possess an edge portion 12 ('edge'). The edge portion 12 may typically include a face lying in a perpendicular orientation relative to one or both of the first and second sides (4/6) of the mounting ring 2, as shown in each of FIGS. 1 and 2 for example. Referring to FIG. 2, the edge portion 12 may comprise the rim (or 'outer rim 12'), and for descriptive convenience only, may alternatively be referred to herein as outer rim 12.

The edge portion 12 may typically but not exclusively further include one or more recesses 14 disposed at and/or about the outer periphery 22 of the mounting ring. Each recess 14 may include an inclined (e.g., angled, rounded, etc.) side wall 16 leading to a 'terminal' structure 18 (e.g., notch, indentation, crease, ledge, 'V'-shaped structure, perforation, etc.), collectively referred to as 'notch 18' for descriptive convenience herein. As will be discussed further herein, such recesses 14, in cooperation with a threaded fastener of a ring cover 52, provide for either or both of indexing a ring cover 52 relative to a mounting ring 2, and locking a ring cover 52 in position relative to the mounting ring 2.

Referring particularly to FIGS. 2 and 2*a*, an exemplary embodiment of a mounting ring 2 includes two or more first latch members 24 disposed at and/or extending from the second side 6 of the mounting ring 2 beyond the periphery 20 of the central opening 8 and within an outer periphery 22 thereof. For descriptive convenience alone, the depicted latch members 24 of FIGS. 2 and 2*a* are referred to individually and/or collectively herein as 'locking flange(s)' 24, although the contemplated embodiments are not limited to structural configurations that would ordinarily be recognized as a flange.

Figure 3:
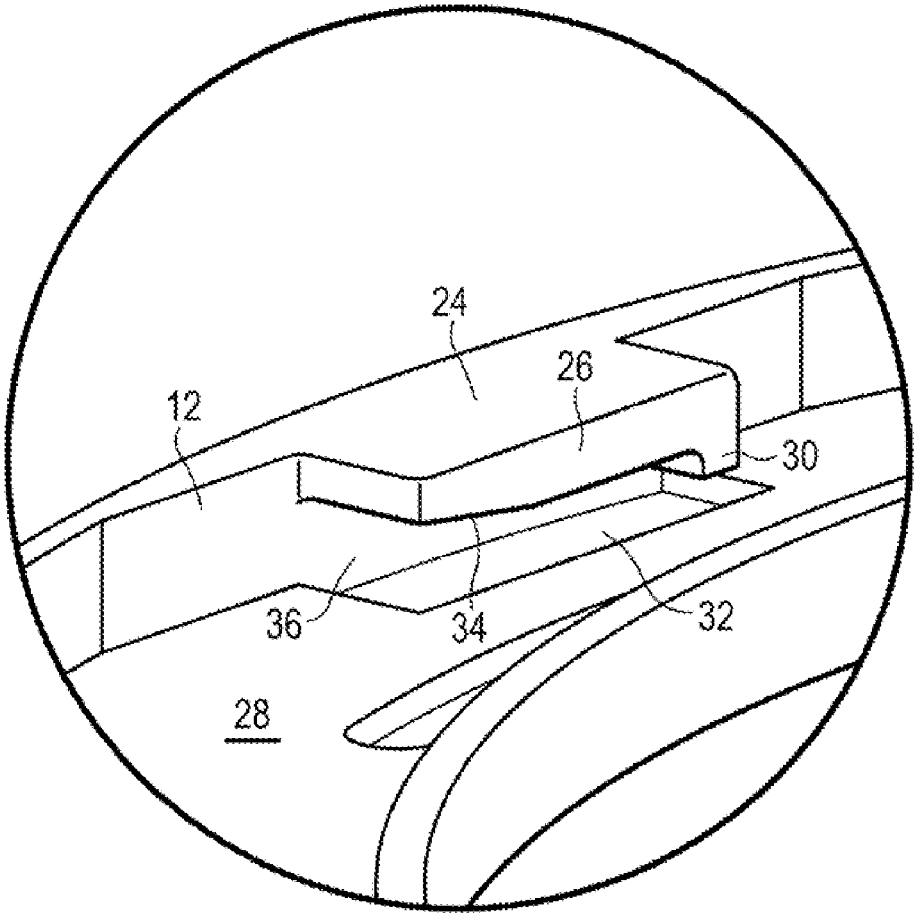
FIG. 3 is a magnified view of Detail A of FIG. 2.

At least one of the two or more locking flanges 24 may be provided proximate to the outer periphery 22 of the mounting ring (as shown in FIGS. 2 and 3), whether or not coupled with the outer rim 12. Alternatively, one or more of the locking flanges 24 may be provided at a surface of the second side 6 beyond the periphery 20 of the central opening 8, but spaced apart from the outer rim. In other embodiments, one or more of the locking flanges 24 may be provided at both the outer rim and at a surface of the second side 6, and perhaps coupled with both. In yet another embodiment, one or more of the locking flanges 24 may be provide at and/or coupled with a rim disposed about the periphery 20 of the central opening 8 of the mounting ring 2. In general, the embodiments contemplate providing one of more of the plural locking flanges 24 nearly anywhere at or proximate to the second side 6 of a mounting ring 2.

With reference to the illustrative detailed view in FIG. 3, each of the two or more locking flanges 24 will typically include a ledge 26 or other projection spaced apart from a facing surface 28 of the second side 6 of a mounting ring 2. The ledge 26 typically includes or is positioned proximate to a stop portion ('stop') 30 positioned at an end of a slot ('receptacle') 32, wherein the receptacle 32 is typically formed between and/or defined by the ledge 26 and the facing surface 28: The embodiments also contemplate that a stop 30 may not be integral with the ledge 26, but will still cooperate therewith during engagement of a ring cover 52. Typically, but not exclusively, receptacle 32 will have a relatively uniform width, wherein such width is defined as the nominal distance between the ledge 26 and the facing surface 28.

The ledge 26 is configured, in at least one embodiment, with a ramped portion ('ramp') 34 at an end thereof opposite the stop 30. The ramp 34 increases the width of the receptacle 32 at an entry 36 thereto, and forms a guide for entry of a corresponding second latch member (e.g., 'engagement tab') into the receptacle 32, as discussed below in more detail.

Figure 4:
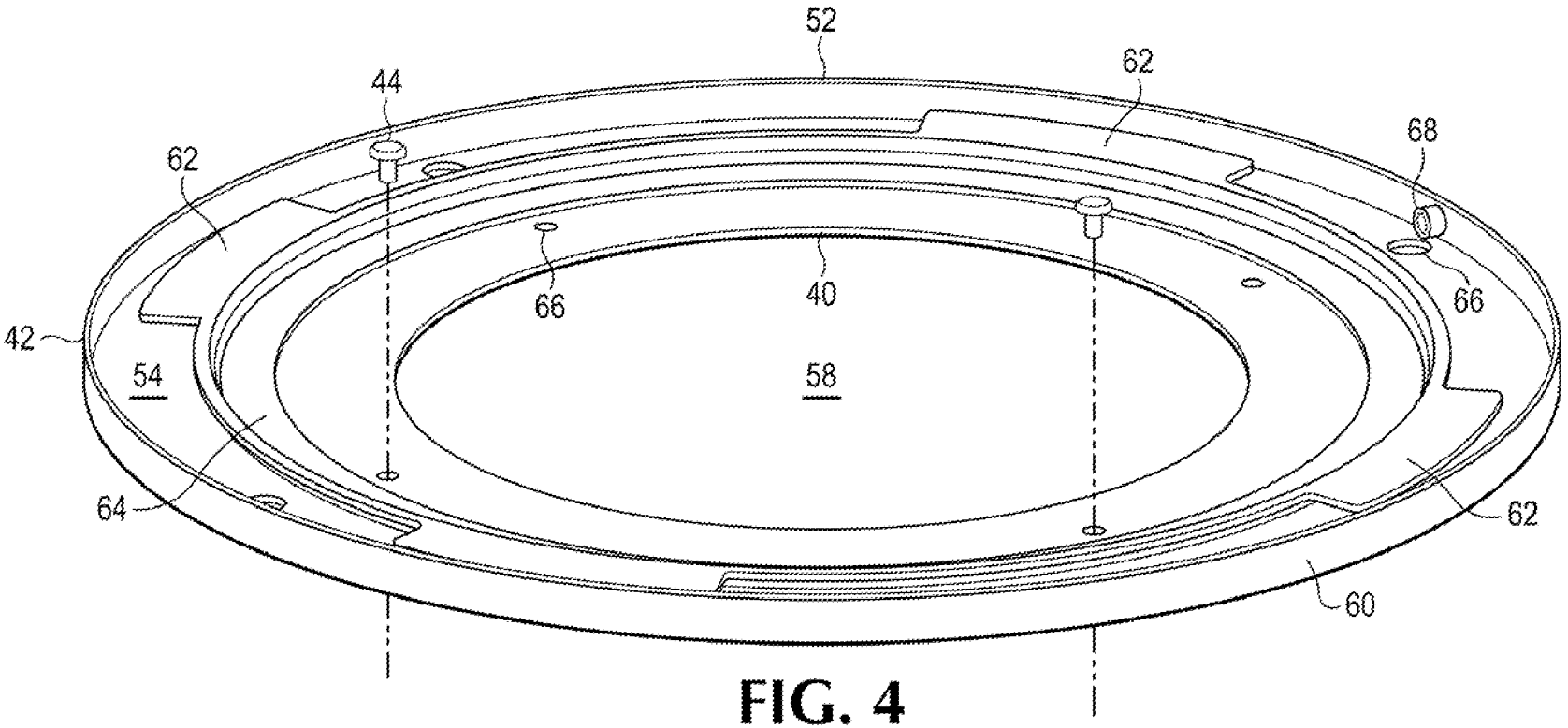
FIG. 4 is a perspective view depicting a first side of a ring cover according to an embodiment of the invention.
Figure 5:
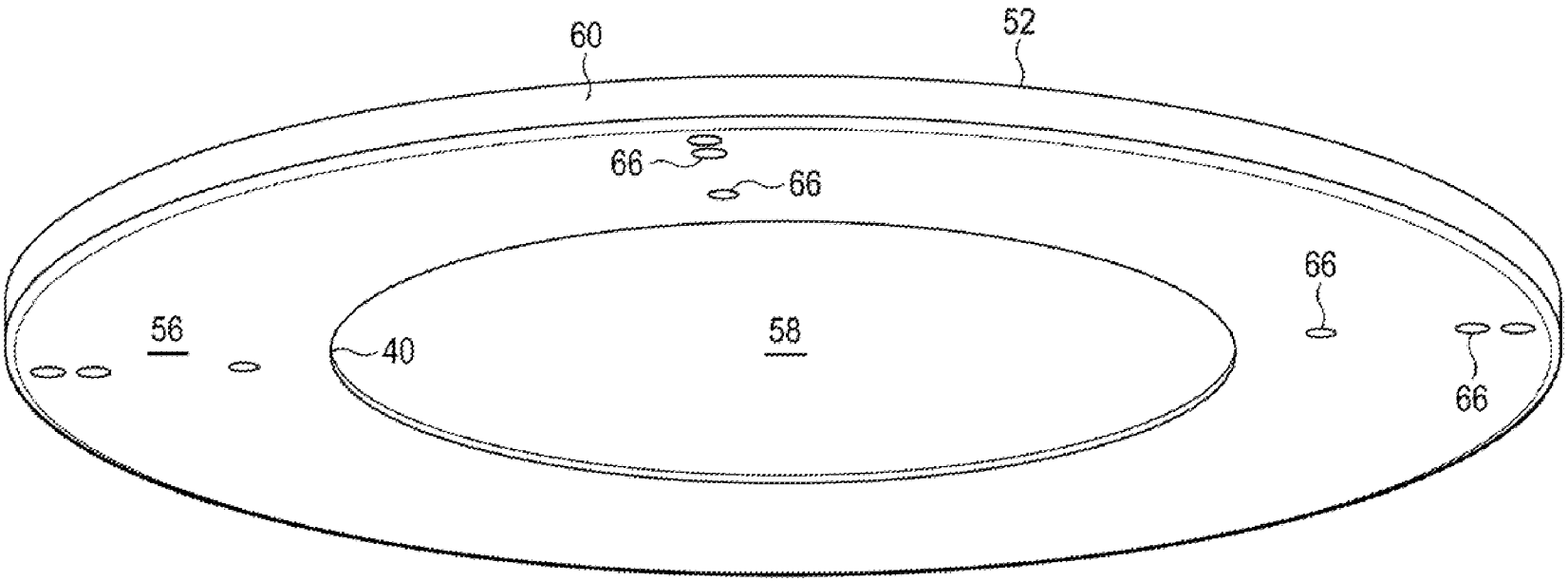
FIG. 5 is a perspective view depicting a second side of a ring cover according to an embodiment of the invention.

The two or more locking flanges 24 are typically disposed at regularly spaced intervals in a circumferential pattern at the second side 6 of a mounting ring, as depicted in the exemplary embodiment in FIG. 2. Such regular spacing enables the several correspondingly regularly spaced second latch members 62 of a ring cover 52 (as shown in FIGS. 4 and 5) to engage with the several first latch members 24 of a mounting ring, generally via a twist-lock type engagement. The contemplated embodiments are not, however, limited only to those having regularly spaced locking flanges 24, and may include at least one flange 24 spaced apart from another flange 24 by a first distance, and spaced apart from a third flange 24 by a second distance.

According to a typical embodiment, and as will be apparent to an ordinarily skill artisan in view of this description and the accompanying drawing figures, each second latching member 62 of a ring cover 52 will engage a corresponding receptacle 32 at an entry 36 thereof, during coupling of a ring cover 52 with a mounting ring 2. Urging the second latching member ('latch tab 62') into and along a length of the receptacle 32 eventually brings the latch tab 62 into contact with stop 30, terminating any further movement of the latch tab into the receptacle 32 and achieving a relatively secure latching engagement of the latch tab with the receptacle.

A stop 30 may comprise an extension of a ledge 26 or of a facing surface 28 of the second side 6, or may constitute a bridging structure connecting a ledge 26 with a facing surface 28. Alternatively, a stop 30 may extend from another structure or surface at the second side 6 of a mounting ring 2. In yet another contemplated embodiment, a stop 30 may comprise a recess (e.g., detent, etc.) formed into or through a surface at the second side 6, and such recessed stop is engaged by a corresponding projecting structure of a latch tab 62 when the latch tab 62 arrives at or approximately at a fully coupled position relative to a corresponding receptacle 32. In a general sense, however, stop 30 may be configured as any structure, and in any manner, that tends to impede further passage of a latch tab within or through a receptacle 32.

In at least one embodiment, a receptacle 32 narrows at an end thereof opposite the entry 36, and may narrow to a width at which a latch tab 62 encounters frictional resistance from each of the facing surface 28 and the ledge 26 during translation into and through the receptacle 32. Such frictional resistance, when present, further helps secure a latch tab 62 in an engaged condition with a first latch member 24.

Although the receptacle 32 has thus far been described as being provided between a facing surface 28 and a ledge 24, a receptacle 32 may be differently configured in an alternative embodiment. For example, a first latch member 24 may comprise one or more structures extending from a facing surface 28 or from another portion of the second side 6 of a mounting ring 2, and a receptacle 32 may be formed into such extending structures at a position above and spaced apart from the facing surface. Likewise, a first latch member 24 may extend outwardly and/or downwardly from an outer rim 12 with or without contacting a facing surface 28, and a receptacle 32 may be provided within such outwardly and/or downwardly extending structure.

In a broad but non-exclusive sense of the inventive embodiments, a first latching member 24 can take any form suitable to receive a corresponding second latching member 62 via a twist-lock engagement action, as is further described below, and as will be apparent to an ordinarily skilled artisan in view of this description and accompanying drawing figures. Therefore, the convenient illustrative embodiments depicted in and described with reference to FIGS. 2 and 3 are not to be interpreted as limiting the otherwise broad structural scope of contemplated alternative embodiments of the invention.

Ring Cover

Turning now to FIGS. 4 and 5, a ring cover 52 will be described according to one or more exemplary but not exclusive embodiments of the invention.

A ring cover 52 is typically substantially planar, having a first side 54 and an opposing second side 56, according to a typical but not exclusive embodiment. As with a mounting ring 2, the qualifying term 'substantially planar' herein contemplates that a ring cover 52 can include various surface features (e.g., projections, recesses, etc.) in one or more embodiments, at a surface of either the first side 54 or the second side 56 thereof. Nevertheless, one or both of the first side 54 and the second side 56, or the overall structure of the ring cover 52 generally lies within and/or defines a plane.

As can be seen in FIGS. 4 and 5, a ring cover 52 may generally resemble a relatively flattened cylinder. Likewise, a ring cover 52 can include concave and/or convex portions, as well as relatively planar portions, as in the earlier described 'hat and brim' configuration of an embodiment of a mounting ring 2. A ring cover 52 typically but not exclusively comprises a relatively planar expanse, and an outer rim 60 generally disposed about an outer periphery of the expanse and extending relatively perpendicularly from the first side 54 thereof. For descriptive convenience alone herein, the portion(s) of a ring cover 52 comprising the outer rim 60 and the typically relatively planar expanse are referred to as the 'main body' of the ring cover 52.

The dimensions (e.g., diameter, etc.) of a ring cover 52, and in particular its outer rim 60, are typically configured to enable the ring cover 52 to be placed over and to cover a corresponding mounting ring 2. For example, as shown in FIG. 1, a mounting ring typically has a first thickness 26, which in part defines an extent by which the outer edge or rim 12 of the mounting ring 2 extends outwardly, for example, from a nominal plane of a structural surface with which the mounting ring 2 is coupled during use. In embodiments, it may be desirable to hide the mounting ring from the view of casual observers, for aesthetic and/or other reasons.

Therefore, in at least one embodiment of the invention, the outer rim 60 of a ring cover 52 will be configured to extend sufficiently from the first surface 54 of the ring cover 52 to fully accommodate therein the first thickness 26 of the mounting ring 2, and to substantially and/or entirely hide the mounting ring's outer edge 12 from view when the mounting ring and ring cover are coupled for ordinary use.

Likewise, a diameter, circumference, and/or other overall dimension of a ring cover 52 is typically configured to exceed one or more of the corresponding dimensions of a mounting ring 2 with which a ring cover is intended to be used. Therefore, the mounting ring 2 can be received (e.g., nested) within a cavity (e.g., concavity, recess, etc.) defined by the outer rim 60 and the expanse provided at the first side 54 of the ring cover 52, as in a male/female engagement.

Additionally, a centrally located opening 58 extending through the ring cover 52 from the first side 54 thereof to the second side 56 thereof is typically provided. As with the central opening 8 of a mounting ring 2, the central opening 58 of a ring cover may have a generally circular outer periphery 42 as shown in FIGS. 4 and 5, but the embodiments are not so limited. Likewise, a cross-wise dimension (e.g., width, diameter, etc.) of a central opening 58 can vary anywhere from less than a millimeter across, to a meter or more across, depending upon an intended application.

In at least one embodiment, the respective central openings of the mounting ring and the ring cover substantially correspond in size with one another. Therefore, any light from a recessed light fixture that passes through the central opening 8 of the mounting ring, also passes relatively unimpeded through the central opening 58 of the ring cover 52 coupled therewith.

For example, a recessed fixture may be a skylight presenting a square opening with sides of approximately two-thirds of a meter (~0.7M) in length, for example. A mounting ring 2 and ring cover 52 can be configured to attach to the ceiling and surround the entire opening of the skylight, with the respective central openings 8/58 of each of the mounting ring 2 and ring cover 52 configured to allow passage of all or nearly all of the light entering a room through the skylight.

In one such exemplary embodiment, an exposed fixture means coupled with the ring cover can include an ultra-violet (UV) filter, which enables sunlight to enter the room as intended, but slows or prevents the fading of materials (e.g., carpet, wood, paint, upholstery, etc.) that would otherwise result from exposure to UV energy in unfiltered sunlight.

A central opening 58 can take nearly any geometric shape, or can take nearly any irregular shape (e.g., animal-shaped, star-shaped, etc). The benefits of a broad array of contemplated irregularly-shaped openings in a ring cover 52 include the ability to present an ordinarily round recessed light fixture as a more aesthetically interesting and/or thematic ornamentation. For example, one or more ring covers 52 having star and/or planet-resembling central openings 58 can aesthetically contribute to a space-themed children's bedroom by making a ceiling resemble a starry night sky.

Alternatively and/or additionally, the shape of a central opening can affect the shape of a light pattern cast upon an opposing surface of a room. For example, one or more central openings 58 shaped to resemble small footprints may present spots of light shaped like somewhat larger footprints at the surface of a floor. As an informational benefit, a wall-mounted ring cover 52 having an opening shaped like an arrow can cast a direction-indicating arrow-shaped light pattern presented at a surface of an opposing wall. Alternatively, a ring cover can include plural central openings 58 configured as letters, numbers and/or other characters, providing the ability to project text (e.g., "Welcome", "Exit", "Step", etc.) upon an opposing surface, for example.

In view of these exemplary embodiments, an ordinarily skilled artisan will recognize that the embodiments by which a central opening 58 of a ring cover 52 may be alternatively shaped and/or sized are nearly endless, and can provide numerous aesthetic and/or functional characteristics not seen in the prior art.

A ring cover 52 will typically include two or more second latch members 62 coupled at and/or extending from the first side 54 of the ring cover 52 beyond a periphery 40 of the central opening 58 thereof and within the outer periphery 42 thereof. As mentioned, the two or more second latch members 62 are typically arranged to correspondingly couple with two or more first latch members 24 of a mounting ring 2 via a twist-lock engagement. For descriptive convenience only, the two or more second latch members 62 will be referred to as 'latch tabs' 62 herein, and as corresponds with the exemplary embodiment shown in FIG. 4.

Typically but not exclusively, a portion of each of the two or more latch tabs 62 extends in an approximately parallel planar relationship relative to and spaced apart from a surface at the first side 54 of the ring cover 52. By being spaced apart from (e.g., elevated above) the first side 54, a portion of a first latch member 24, for example ledge 26, is able to pass between the latch tab 62 and the surface of the first side 54 as the latch tab 62 engages with the receptacle 32 of the first latch member 24.

Further, in an embodiment (see FIG. 4), the two or more latch tabs 62 extend from a latch member ring 64 (or 'latch tab ring' 64) that is coupled with the first side 54 of the ring cover 52. Each of the latch tab ring 64 and the main body of the ring cover 52 may be manufactured separately from one another, and then subsequently coupled together in a relatively concentric arrangement substantially as shown. Such coupling may include welding, riveting, soldering, bolting, or any other means or method of attachment capable of securely bearing a reasonably expected load of an exposed fixture means suspended therefrom, without detaching, deforming, or otherwise degrading.

Either or both of the main body of the ring cover 52 and the two or more latch tabs 62 and/or latch member ring 64 may typically, although not exclusively, be formed from a sheet material (e.g., sheet metal, etc.) that is bent, stamped, thermoformed, or otherwise configured as shown and/or described herein by any suitable means and/or method. A ring cover 52 is also typically relatively rigid, according to a preferred but non-exclusive embodiment. Such rigidity generally helps prevent deformation and/or damage in response to an applied load throughout substantially the entire useable lifetime of a ring cover, (e.g., many years).

Latch tabs 62 may be formed individually or in grouped subsets, rather than as part of an integral latch tab ring 64, and be coupled with a main body of the ring cover 52 by any of the same means and/or methods described above regarding a latch tab ring 64, or by any other suitable means.

Alternatively, latch tabs may be formed integrally with the main body of the ring cover. For example, the generally planar expanse of the ring cover main body can be punched, drilled or otherwise perforated to delineate the general outline of each latch tab 62 except for an attachment portion. Each tab may then be deformed toward the first side of the ring cover 52, while remaining attached to the generally planar expanse at the attachment portion.

Although FIG. 4 depicts the several latch tabs 62 extending outwardly from the central opening 58, in at least one alternative embodiment, one or more of the latch tabs 62 can instead extend inwardly toward the central opening 58, and a corresponding one or more of the first latch members 24 of a mounting ring 2 will be correspondingly configured to receive and retain the inwardly extending latch tabs 62. Further, in at least one embodiment, one or more of the first latch members 24 are configured and/or arranged to universally receive and retain either or both of an inwardly and an outwardly extending latch tab 62.

In yet another embodiment, a portion of a latch tab 62 extends neither inwardly toward the central opening 58, nor outwardly away from the central opening, but rather extends in a somewhat lateral orientation relative to either or both of such inward or outward orientations. In such lateral orientation, the one or more latch tabs 62 are likewise configured to engage with a first latching member 24 via a generally circular twist-lock engagement.

A ring cover 52 typically, although not exclusively, includes one or more attachment features 66 presented at a second side 56 thereof, wherein the attachment features 66 are configured to enable coupling of an exposed fixture means with the ring cover 52. As shown in FIGS. 4 and 5, such features can include one or more openings formed through the ring cover 52 from the first side 54 to the second side 56 thereof, and configured to receive and retain a portion of a fastener 44 (e.g., a screw, bolt, pin, peg, clip, anchor, etc.) therethrough, for example.

Alternatively, an attachment feature 66 can comprise a bracket, flange, lip, hook, slot, tab, adhesive or nearly any other material and/or structure configured to enable coupling of an exposed fixture means securely with the ring cover 52. Such coupling can involve a twist lock engagement, but the embodiments are not so limited. Generally, however, the method and/or means of coupling an exposed fixture means with a ring cover will be configured to avoid interfering with the coupling of the ring cover 52 with a mounting ring 2. For example, fasteners coupling an exposed fixture means with a ring cover generally will not extend far beyond the first side 54 of the ring cover 54, wherein they might interfere with a close, twist-lock engagement of the ring cover 52 with the mounting ring 2.

Figure 6:
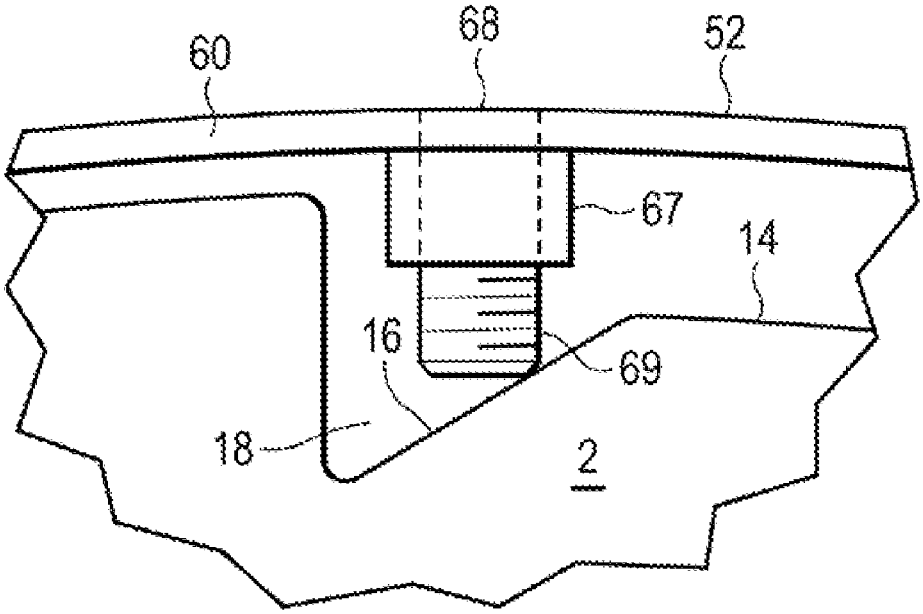
FIG. 6 is a detailed view depicting an indexing fastener of a ring cover engaging a recess of a mounting ring according to an embodiment of the invention.

In a typical but non-exclusive embodiment, a fastener 68 couples with and/or extends through the outer rim 60 of the ring cover 52 (see FIGS. 4 and 6), and may also engage with a guide/stabilizer 67 provided at the outer rim 60, as shown in FIG. 6. For example, a threaded fastener 68 can engage with threads of a hole provided through the outer rim 60 and/or guide/stabilizer 67, enabling the fastener 68, when turned about a central axis of a shaft thereof, to intrude into and/or be retracted from an interior of the ring cover lying within the outer rim 60. Therefore, when the ring cover 52 is closely engaged in a twist-lock manner with a mounting ring 2, the fastener 68 can be rotated until an inner end 69 thereof contacts the edge 12 of the mounting ring 2.

Slightly overdriving the fastener 68 past the point of contact creates a high frictional resistance to dislocation between the screw inner end 69 and the mounting ring, in the manner of a 'set screw', locking the ring cover in place relative to the mounting ring and preventing inadvertent decoupling of the former from the latter.

As summarized above, a relative position of the threaded fastener 68 to the two or more latch tabs 62, will typically correspond with a position of a recess 14 provided at an edge 12 of the mounting ring 2 relative to the two or more locking flanges 24 thereof. For example, as seen in FIGS. 2 and 4, each recess 14 in the mounting ring is located approximately midway between two adjacent locking flanges 24, and the fastener 68 is located approximately midway between two adjacent latch tabs 62. Therefore, no matter which latch tab 62 of the ring cover 52 engages with which locking flange 24 of the mounting ring, the fastener 68 will align with one of plural provided recesses 14, providing convenient rotationally variable coupling orientation between the ring cover and the mounting ring. While such rotationally variable coupling provides significant benefits (e.g., simplicity during installation), the embodiments are not so limited, and either more or fewer recesses 14 (or no recesses) can be provided according to alternative embodiments.

Further, the embodiments contemplate that a user may sometimes incompletely engage the several ring cover latch tabs 62 with the several mounting ring locking flanges 24. For example, the user may not fully rotate the ring cover relative to the mounting ring, so that the latch tabs' fail to encounter one or more stops 30 of the locking flanges. In such situations, the ring cover is not fully secured, presenting the possibility that the ring cover may later inadvertently and unpredictably separate from the mounting ring due to vibration or handling for example, potentially causing property damage and/or injury.

However, according to an already described embodiment, a recess is formed with an inclined side wall 16 (see FIGS. 1-2). Referring to FIG. 6, inserting the fastener 68 through the outer rim 60 of the incompletely secured ring cover 52 causes an inner end 69 of the fastener 68 (relative to the ring cover rim 60) to engage the inclined side wall 16 of the recess 14. Further insertion of the fastener 68 applies force to the inclined side wall 16, resulting in the inner end 69 of the fastener 68 dislocating laterally and downwardly along the inclined side wall 16 until it reaches a provided notch 18, which then prevents any further lateral movement of the fastener 68.

Because the fastener 68 is coupled with the ring cover 52, and the inner end 69 of the fastener 68 translates laterally relative to the inclined side wall 16 of the mounting ring, the fastener 68 correspondingly urges the ring cover 52 to counter-rotate relative to the mounting ring 2, until the ring cover arrives at an 'indexed' position defined by the arrival of the fastener inner end 69 at the notch 18.

Further, because an action of the fastener 68 in cooperation with the features of recess 14 (e.g., inclined side wall 16, notch 18, etc.) causes such indexing of the ring cover relative to the mounting ring in an embodiment, the described features are specifically defined herein as an 'indexing fastener', an 'indexing recess', and an 'indexing notch', and the described interaction of these features is defined herein as an 'indexing engagement'.

While the indexing fastener 68 has been mainly described herein as a threaded fastener, the embodiments are not so limited. For example, an indexing fastener 68 can be configured as a spring loaded device including a plunger, tab, peg, knob, point, or other structure, or as a sliding pin, etc. Likewise, in at least one embodiment, the indexing fastener 68 is coupled at an interior surface of the outer rim 60 rather than extending therethrough, and may also be spring loaded, although the embodiments are not so limited.

Additionally, the indexing fastener 68/notch 18 engagement prevents inadvertent disengagement of the ring cover from the mounting ring. As mentioned, even in embodiments of a mounting ring lacking a recess, the ring cover will generally be held in a fixed position relative to the mounting ring due to a strongly, frictional engagement of an inner end 69 of the fastener 68 with the edge 12 of the mounting ring 2.

As will be readily recognized by one having skill in the art, coupling a ring cover with a mounting ring, according to a typical embodiment, typically involves the operations of:

(1) positioning the ring cover in a close, approximately concentric and approximately parallel planar relationship relative to the mounting ring, with the second side of the mounting ring facing the first side of the ring cover, (2) maintain the approximately concentric and approximately parallel planar relationship while bringing the ring cover into contact with the mounting ring, and (3) rotating the ring cover either clockwise or counter-clockwise (as the case may be in alternative embodiments) until the second latch members of the ring cover engage the corresponding first latch members of the mounting ring, preferably until one or more of the second latch members encounter a stop associated with one or more of the second latch features.

Exposed Fixture Means

As described above to some limited extent, embodiments of the invention enable a user to convert (e.g., retrofit) an existing recessed light fixture, for example, with any of a wide number of aesthetic and/or functional enhancements. The term 'exposed fixture means' is intended herein to encompass any of a wide variety of structures, all of which share a common structural feature—each is configured to couple with a second side of a ring cover as described herein. Therefore, an exposed fixture means is structurally distinct from a recessed fixture.

As will be understood by an ordinarily skilled artisan in view of this description and the accompanying drawing figures, at least a portion of an exposed fixture means tends to extend away from a structural surface at which a mounting ring/ring cover is coupled, rather than being recessed into the structural surface. For example, an exposed fixture means extends into and/or is exposed within a room (e.g., kitchen, bedroom, lobby, hallway, etc.) according to a typical embodiment, rather than being recessed into and/or behind a structural surface (e.g., a wall, ceiling, fence, etc.) of the room.

This distinction does not, however, mean that all portions of an exposed fixture means ('EFM') are exposed to a room and/or extend beyond a structural surface in every embodiment. Nor must an EFM be in a room per se, but rather one or more embodiments may be coupled at an exterior surface (e.g., exterior siding along an exterior wall of a building, at an exterior 'ceiling' in an open portico or atrium, etc.).

Figure 7:
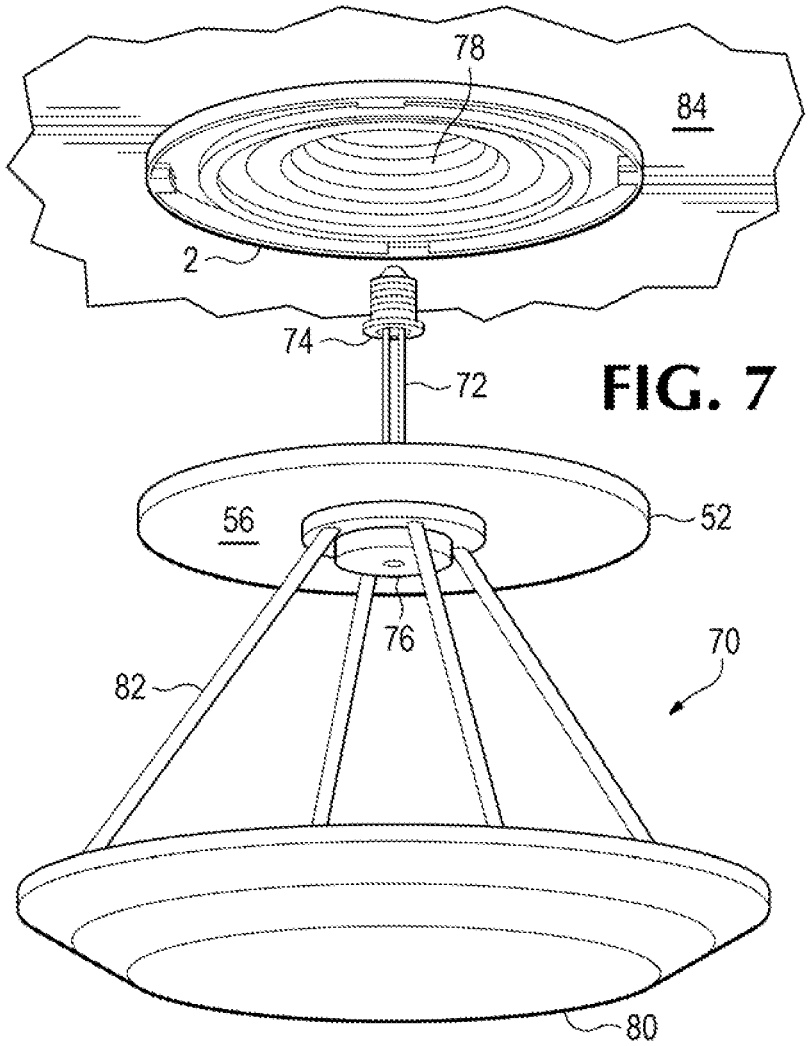
FIG. 7 is an exploded perspective view depicting a pendant, electrically operable exposed fixture means according to an embodiment of the invention.

In a broad but non-exclusive class of the invented embodiments, and with reference to FIG. 7, an EFM 70 includes one or more conductive lines 72 (e.g., electrical cord, optical waveguide, data transmission line, etc.) each having a first end 74 that extends inwardly toward a recessed fixture 78 beyond the first side of the ring cover, and a second end (not shown) extending beyond or presented at the second side 56 of the ring cover 52.

A conductive line 72 may be configured to convey either or both of light and electricity from the first end 74 of the conductive line 72 (presented at and/or beyond the first side of a ring cover 52) to the second end of the conductive line 72. For example, a light bulb of a recessed fixture 78 may remain operative in an embodiment, but a ring cover 52 blocks substantially all of the light bulb's light from entering a room directly. Therefore, light is conveyed from inside the recessed fixture 78 to the second side 56 of the ring cover 52 (e.g., and into a room, for example) by a conductive line 72 configured as an optical waveguide (e.g., glass, plastic, or another light-conducting material, whether configured as one or more fibers, bundles, rods, or other light conducting configurations)

Alternatively, the light bulb of a recessed light fixture 78 may be removed, and a first end 74 of an electrically conductive line 72 may be coupled with a socket or other connection of the recessed light fixture 78 at which the light bulb would otherwise normally be coupled. The conductive line 72 then conveys electricity from the first end 74 to the second end of the conductive line 72, providing electricity to an electrically operable device 76 coupled at the second end of the conductive line 72 and configured as a part of an EFM 70. For example, electricity from the recessed fixture 78 may be used to operate an electrical device 76 (e.g., a fan motor, a light bulb, a liquid crystal display screen, etc.) provided at or beyond the second side 56 of the ring cover 52.

In an embodiment wherein the conductive line 72 is configured to convey electricity, a 'live' conductive line 72 will typically include an insulated wire or cable, as may be required to meet various national, state, municipal, or other electrical code requirements. Likewise, the first end of the conductive line 72 will generally be configured to operatively couple with an existing electrical interface provided in the recessed fixture 78. Such interface may be configured as a threaded socket, a receptacle for engaging with a plug inserted in a male/female type engagement, a magnetically retained engagement, etc. Nevertheless, contemplated non-exclusive embodiments include a first end 74 of a conductive line 72 configured structurally to engage with any of the wide variety of interface structures provided within a recessed fixture 78.

In some instances, a recessed fixture may comprise a standard electrical outlet (e.g., two- or three-prong 110VAC outlet, etc.) recessed within and presented at a structural surface (e.g., a ceiling, wall, floor, etc.). Nevertheless, a mounting ring 2 and ring cover 52 may be coupled with a structural surface so as to substantially surround and hide the outlet from casual view, and a conductive line of an EFM can be operatively coupled with the outlet. As this example illustrates, the contemplated embodiments are not limited to use and/or interface with recessed light fixtures alone, but likewise include any of a wide variety of recessed fixtures.

In a broad sense, an EFM can include any device coupled with and/or at a second side 56 of a ring cover 52, as mentioned. The contemplated embodiments that receive electricity from a recessed fixture 78 via an electrically conductive line 72, include not only light emitting devices (e.g., a light bulb, a light emitting diode, a liquid crystal display, a plasma display, an image projector, a track lighting arrangement, etc.), but also motorized devices (e.g., a fan, a rotating light emitting device, a rotating hanging 'mobile' sculpture, a rotating color-changing light filter, an analog clock, etc.), and/or any other electrically operable devices whether or not recognized as being either light emitting or motorized (e.g., a digital clock, a liquid crystal display board, a loudspeaker, a security camera, etc.). Additionally, embodiments of an EFM may also include any combination of one or more light emitting devices, motorized devices, and/or other electrically operable devices.

Further, an EFM can comprise a multiplexing device, configured to convert a single recessed light fixture 78, for example, into multiple light fixtures, each deriving electrical power either directly or indirectly from the recessed fixture 78 via the one or more conductive lines 72.

Additionally, the term 'exposed fixture means' also encompasses a wide range of non-electrically operable structures and/or devices, as well as electrically operable devices that derive power from a source other than a recessed fixture (e.g., battery-powered devices, solar-powered devices, etc.). For example, the embodiments contemplate light shades 80 (see FIGS. 7 and 8), lenses and/or light filters, informational signs, privacy screens, smoke alarms, etc.

Also contemplated are various light re-directing devices, that re-direct at least a portion of the light from a recessed fixture into a different direction and/or an additional direction. Examples of light re-directing devices include but are not limited to light reflecting structures (e.g., mirror ball, etc.) light-refracting structures (e.g., glass prism, fresnel lens, crystal chandelier, etc.), and/or lighting structure utilizing one or more optical waveguides, a mobile, etc., as within the scope of an EFM.

In at least one alternative embodiment, a conductive line 72 is configured appropriately to convey an electrical media signal including sound and/or imagery (e.g., cable television signal, satellite television or radio signal, etc.) and/or a data signal (e.g., Ethernet, Digital Subscriber Line, etc.) from a recessed fixture to an exposed fixture means. Therefore, in at least one embodiment, operably coupling with an electrical source located beyond the first side of the ring cover comprises coupling a first end of the conductive line 72 with a source of a media and/or a data signal presented at or accessible via a recessed fixture. Of course, connection with an optically transmitted media and/or data signal is also contemplated in a related but alternative embodiment.

Therefore, an embodiment of a conductive line 72, as well as the first and/or second ends thereof, may be configured as any one or more of numerous signal transmission lines and/or connections, respectively, according to technologies already known in the art or that may be later developed. Such technologies include, but are not limited to, 'RCA'-style connectors, High Definition Multimedia Interface (HDMI), coaxial cable and/or connectors, Ethernet (RJ45), 'vampire' audio cable, IEEE 1394 (e.g., 'Firewire', etc.), Universal Serial-Bus (USB), or nearly any other, as will be recognized by an ordinarily skilled artisan in view of this description.

Various embodiments of an electrically operable EFM may also include circuitry enabling a user to affect an operational condition of the EFM via a wire-carried (e.g., electrical, optical, etc.) and/or wireless (e.g., infrared, radio wave, WiFi, cellular phone, etc.) signal. A control panel, switch and/or remote control device (collectively 'control device') can likewise be provided in controllable communication with the EFM so that commands entered at the control device cause a corresponding and/or responsive change in an operational condition of the EFM (e.g., turning power on/off, altering a brightness of a light or a speed of a fan, changing a color of light filter, altering an illumination angle, etc.).

Alternatively, an electrically operable EFM can include circuitry configured to alter an operational condition thereof in response to a detected sound, movement, preset temperature threshold, or other environmental influence. Such circuitry may take the form of one or more of a thermal sensor, a microphone or other acoustic sensor, an infrared sensor, etc., as would be known to an ordinarily skilled artisan.

At least one embodiment of an EFM contemplates one or more hooks, pegs, clips, eyelets, rings, or other item retaining structures coupled at the second side of a ring cover, enabling a user to hang or otherwise retain selected items (e.g., a plant, an article of clothing, tools, etc.). In yet another embodiment, a recessed light fixture beneath a kitchen cabinet can be converted with an embodiment of the invented mounting ring and ring cover, and an EFM coupled therewith can comprise a media player (e.g., radio, television, compact disc player, etc.), a time-keeping device, a thermal food preparation device, a fold-down food storage rack, an additional shelf, or virtually any other kitchen appliance, storage device, entertainment device, or tool.

An EFM can comprise a single integrated component (e.g., a cast epoxy light shade, a metal framework, a glass dome, etc.) attachable directly with a ring cover. Alternatively, an EFM can be formed of two more separate component parts that are assembled together to form the EFM, and may include one or more component parts specifically configured to enable attachment of the EFM with a ring cover.

Still further, a ring cover may be formed as an integral part of an EFM rather than being separate therefrom and attachable thereto via fasteners or another attachment means or method. For example, a resin-based shade can be cast such that a ring cover is embedded within the resin when cured, or such that uncured resin flows through one or more openings in, or around one or more structures projecting from, a ring cover, thereby solidly coupling the ring cover with the resin structure when cured.

An ordinarily skilled artisan will recognize that the structures encompassed by the term 'exposed fixture means' is not limited to only the numerous illustrative examples described herein. Rather, it will be recognized that the embodiments equally extend to a wide range of other structures, configurations, and arrangements not expressly mentioned herein. It is impractical and unnecessary to list all structures contemplated as falling within the scope of an EFM according the invented embodiments. However, the term 'exposed fixture means' (EFM) herein is expressly intended to include all such structures, unless specifically limited to an identified subset of such structures in a claim originally presented herein, or as later amended.

Preferred and Alternative Embodiments

According to a preferred embodiment of the invention, a relatively universal mounting ring/ring cover/EFM system is provided. By 'relatively universal', it is intended that ring covers and mounting rings can be provided in corresponding sets, wherein a ring cover of a particular designation universally mates with any mounting ring of that same designation.

For example, a mounting ring may be sized and otherwise configured according to a particular standard, and be designated as a 'Size 3' mounting ring. Correspondingly, a ring cover sized and otherwise configured to operably engage with a Size 3 mounting ring will be designated a 'Size 3' ring cover. According to a preferred embodiment, any Size 3 designated ring cover will operably engage with a Size 3 designated mounting ring. Additional and/or other designations can be likewise assigned to either larger or smaller mounting rings and ring covers, or to designate a particular configuration of corresponding first and second latch members, for example.

Typically providing universality in such embodiments are the configurations, arrangements, dimensions, and other aspects of the structures provided at and/or about the second side of the mounting ring, and at and/or about the first side of the ring cover. For example, the first latch members of each mounting ring should be arranged, sized, and otherwise configured to operably engage and retain corresponding second latch members of any similarly designated ring cover.

Of course, other structural features and/or characteristics of one or both of a ring cover and/or mounting ring can affect an aspect of operable engagement. Therefore, such features as indexing fasteners, recesses, outer rims, etc. will also be configured to facilitate operable engagement between system components having a common 'universality designator' (e.g., Size 3).

In the same way, EFM's can be configured to correspond structurally to the ring covers of a particular universality designator. Therefore, any EFM coupled with a mounting ring via a ring cover in a particular situation, can at any time be easily removed and replaced with another EFM identified by the same universality designator.

In at least one alternative embodiment, a ring cover 52 may be provided without a central and/or other opening disposed therethrough. For example, a ring cover 52 so configured could be used to protect an already installed recessed fixture from damage during construction (e.g., original or remodeling), to seal a recessed fixture to prevent any of air, light, pest, or other infiltration via the recessed fixture, or to prevent access by children, pets, etc. to objects and/or energized circuits located at or within the recessed fixture.

According to at least one preferred embodiment, an EFM is a 'pendant fixture' 70 (e.g., a pendant light fixture, a pendant fan fixture, etc.), an exemplary embodiment of which is shown in FIG. 7. The term 'pendant fixture' as used herein generally refers to an EFM that extends downwardly from an attachment with a ring cover 52. Generally, a substantial portion 80 of the structure of a pendant EFM 70 is coupled (e.g., suspended, hanging, etc.) at a second end of, and is held spaced apart from the second side of a ring cover 52 by, one or more extended cords and/or arms 82, as substantially shown in FIG. 7.

For example, a pendant EFM 70 may be coupled with a ring cover 52 at a first end of one or more of an extended cord, chain, cable, or other such flexible structure (collectively 'cord' herein for descriptive convenience only). As such, a pendant fixture may hang freely and relatively vertically in response to a gravitational force, and likewise may have a tendency to deviate from such relatively vertical position (e.g., to swing, as like a pendulum, etc.) in response to an extrinsic, relatively minor applied force or other influence (e.g., wind, incidental physical contact, etc.).

However, in alternative embodiments, a pendant fixture is held relatively immobile by one or more arms 82 coupled somewhat rigidly at a first end thereof with a ring cover 52, and/or at a second end thereof with a substantial structural portion (e.g., shade 80) of the EFM held apart from the ring cover 52. For example, a pendant fixture may depend or otherwise extend from a second side of a ring cover via one or more relatively rigid, elongate support structure(s) (e.g., an arm, rod, tube, rail, etc.).

In such embodiments, a pendent fixture may extend at nearly any angle (e.g., horizontally, vertically upwardly or downwardly, diagonally, etc.) from and relative the second side of a ring cover and/or a structural surface 84 at which a corresponding mounting ring 2 is coupled. Rather than freely swaying, a relatively rigidly coupled pendant fixture may tend to resist positional deviation in response to extrinsic influences (e.g., wind, incidental physical contact, etc.), except in response to the application of a relatively high displacement force (e.g., a physical strike or impact, etc.).

A first end of such relatively rigid elongate structure (collectively 'arm' herein for descriptive convenience only) or a cord (e.g., via a knob or other structure coupled at the first end thereof) may be configured with threads, or otherwise configured, to structurally couple typically with the ring cover, but additionally or alternatively with the mounting ring in at least one embodiment. For example, threads provided at the first end of a pendant fixture arm or cord may engage with the central opening 58 of the ring cover 52, or may pass through the central opening of the ring cover and engage with threads provided within the passage of the central opening 8 of the mounting ring 2.

An arm or cord of a pendant fixture may alternatively be coupled with a ring cover via any of a wide range of suitable attachment methods and/or structures, including but not limited to welds, clips, elongate fasteners (e.g., screws, bolts, pins, rivets, etc.), nuts, flanges, hooks, collars, clamps, twist-lock structural arrangements, etc., or any combination thereof. Those having skill in the art will recognize that suitable attachment methods and/or means include any that are capable, either individually or plurally, or as combined with any other, of retaining an EFM in a coupled engagement, whether detachably or permanently, with a ring cover during and/or throughout use, consistent with this description and the wide range of EFM embodiments contemplated herein.

The broad range of contemplated attachment methods and/or means configured to couple a second end of a pendant fixture arm or cord with a portion of pendant EFM spaced apart from the first end of the pendant fixture arm or cord, include any one of or combination of those described above with regard to coupling the first end thereof with the ring cover. Alternatively and/or additionally, such attachment methods and/or means can likewise couple one or more portions of a pendant fixture (e.g., an electrically operable device, etc.) at a portion of a pendant fixture arm or cord intermediate the first and second ends thereof.

An arm of a pendant fixture may have a passage extending longitudinally through a length thereof, and a conductive line 72 may extend through at least a portion of the passage length, with a second end of the conductive line then operably coupling with an electrically operable portion of the pendant fixture coupled somewhere along and/or at the second end of the arm of the pendant fixture.

Alternatively, a conductive line 72 may extend along a pendant fixture arm or cord, whether relatively parallel therewith or wrapped therearound, and whether coupled therewith or relatively separate therefrom. In alternative embodiments, a conductive line 72 may be coupled with a pendant fixture arm or cord via coupling structures (e.g., clips loops, recesses, hooks, etc.) integrally formed with the arm or cord, or via relatively separate and attachable coupling structures suitable to engage and retain a portion of a conductive line 72 relative to a portion of a pendant fixture arm or cord.

Figure 8:
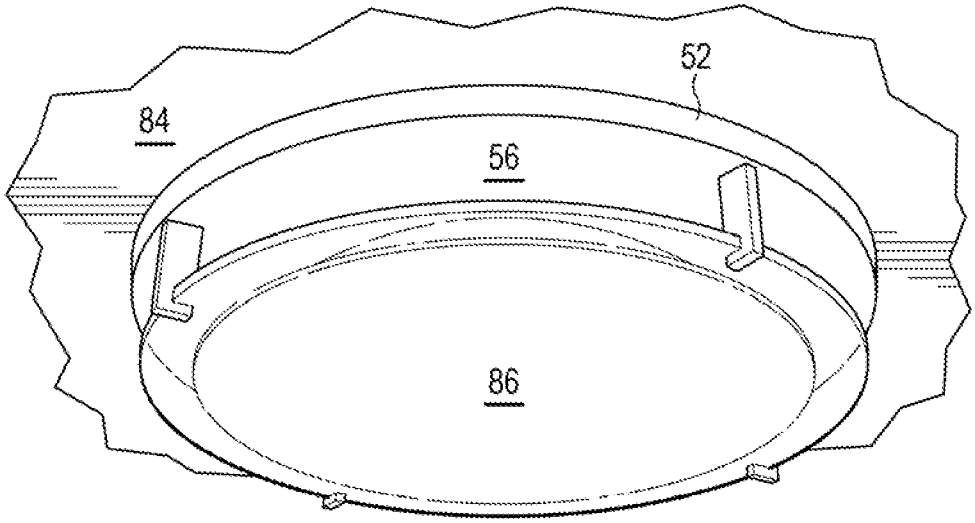
FIG. 8 is an oblique, perspective view depicting a surface mounted, non-electrically operable exposed fixture means disposed at a structural surface according to an embodiment of the invention.

According to a preferred embodiment, an EFM is a surface mounted fixture (e.g., a light fixture, a shade, a ceiling fan, a wall sconce, etc.), as shown in FIG. 8. In contrast to a pendant EFM, most if not all of the structure of a surface mount EFM 86 is not held apart from the second side 56 of the ring cover 52 by an extended cord and/or arm. Rather, a substantial portion of a surface mounted EFM 86 is generally coupled more closely proximate to the second side 56 of a ring cover 52 when installed for use. While a surface mounted EFM 86 may have pendant portions extending therefrom, the main structure of the surface mounted EFM 86 is generally not held apart from the ring cover by an extended cord and/or arm.

Because EFM structures within the contemplated scope of the embodiments may vary greatly, a judgment of whether a particular EFM would be considered surface mounted or pendant fixture will sometimes be a subjective determination. Therefore, while these terms provide a convenient descriptive distinction, they will not in all cases indicate a clear and unequivocal structural distinction. Another convenient but none limiting way to envision a subjective structural distinction between the two embodiments might be to consider that a surface mounted EFM 86 is typically held at or near a structural surface 84, while a pendant EFM 70 tends to hang from, project from, and/or stand up from a structural surface 84. Again, while such descriptions provide a convenient guide for classifying the embodiments, the embodiments contemplate structural EFM configurations that could be equally validly described as either pendant or surface mounted.

In an embodiment, a ring cover can be formed initially without a central opening being provided therethrough, and/or without holes being provided for attaching a specific EFM via fasteners. Instead, one or more perforations, creases, weakened portions, bendable tabs, plugged holes, or otherwise convertible structures may be provided through or at a first or second side of a ring cover.

A user can then punch out, remove, bend, or otherwise alter one or more of the provided convertible structures to create a desired central opening size and/or shape, or to selectively configure one or more attachment points for coupling a selected EFM with the ring cover. Nevertheless, such 'user configurable ring cover' will generally, although not exclusively, already possess latch tabs 62, for example, at its first side 54, enabling it to relatively universally couple with a corresponding mounting ring according to the described embodiments.

In at least one embodiment, a central opening is formed through a ring cover as described above, and an expanse (e.g., sheet, membrane, foil etc.) of a user configurable material (e.g., paper, polymer, pressed board, metal, textile, etc.) is then adhered to or otherwise coupled at either of the first side or the second side of the ring cover so as to extend across and cover the central opening. In such embodiments, a user may then cut or otherwise create an opening though the user configurable material, thus forming the operative central opening in the ring cover.

Alternatively, pre-formed expanses of a material may be selectively disposed at and/or coupled with either of a first or second side of a ring cover extending across all or some portion of a pre-formed central opening, wherein the pre-formed expanses alter a shape, size, or other configuration or dimension of the central opening of the ring cover. Such embodiments provide an additional level of configurability and enhancement applicable to existing recessed fixtures.

In at least one alternative embodiment, latch tabs are provided at the second side of the mounting ring, and corresponding receptacles are provided at the first side of the ring cover, in an arrangement generally inverse of that described above, but likewise providing for a twist-lock mode of engagement therebetween.

In at least one alternative embodiment, the latch tabs and receptacles of a ring cover and mounting ring, as the case may be, are configured to engage when the ring cover is pushed against the mounting ring, but may be disengaged by rotating the ring cover relative to the mounting ring. In such embodiments, the latch tabs may extend from the first side of the ring cover in a cantilevered fashion, for example, and have an outwardly presented inclined face leading to a shelf portion located between the inclined face and a surface at the first side of the ring cover. In response to a force applied by the inclined face of a latch tab against a portion of a first latch member, the latch tab is configured to deflect, allowing the shelf portion of the latch tab to pass inwardly toward the receptacle. When the shelf portion arrives at the receptacle, the latch tab returns to a resting non-deflected position, engaging the shelf portion in a latch condition with the receptacle.

In at least one embodiment, one or more stop portions are provided not at a latch member (e.g., of a mounting ring) proximate to a receptacle thereof (see feature 30 in FIG. 3, for example), but rather are provided as a portion of a corresponding latch member (e.g., latch tab 62 of ring cover 52) intended to be received in the receptacle. Nevertheless, the one or more stop portions so provided will be configured to allow passage of a latch tab 62 into and partially through a receptacle, but to impede further passage of the latch tab 62, therefore defining a fully coupled condition of the latch tab with the receptacle.

Further alternative embodiments are contemplated within the scope of the invention, and will be recognized by an ordinarily skilled artisan in view of the descriptions and drawing figures provided herein. Therefore, the scope of the invention is intended to extend to the full extend of the claims as interpreted consistently with this description and the accompanying drawing figures, and to all equivalents thereof, excluding only valid prior art devices, systems, and/or methods.

Generally, the embodiments are directed to a recessed fixture conversion apparatus, system, and method. By 'conversion', it is generally meant herein that the embodiments convert (e.g., retrofit, alter, modify, etc.) one or more of the appearance, function, performance, and/or another aspect of an already existing recessed fixture, or more particularly, of a structural surface at which a recessed fixture is disposed. Typically, although not exclusively, such conversion does not require disassembling, removing or reconfiguring the existing structure of the recessed fixture itself. Removing a light bulb from a recessed fixture, for example, is not typically considered herein to constitute 'disassembly' of the recessed fixture.

ADVANTAGES OF THE INVENTION

As described above, one or more of the embodiments provide numerous advantages over prior art solutions, and/or solve problems not addressed at all in the art.

For example, the embodiments of a mounting ring that attach to the material of a structural surface and/or a structural member (e.g., wooden or metal wall stud, roof truss, etc.) lying behind a structural surface, are capable of bearing a much greater load than can a recessed fixture itself. Therefore, the inventive embodiments enable the use of a far greater scope of EFM types, sizes, and configurations. Because of the strong physical attachment provided by the mounting ring and ring cover, an EFM having a substantial weight—exceeding fifty kilograms in at least one embodiment—can be coupled at a structural surface as a retrofit and/or enhancement to a recessed fixture.

An arrangement of slotted fastener holes provided though a mounting ring enables rotational and/or other positional adjustment of a mounting ring 2 throughout its useful life, facilitating initial installation and enabling adjustment as a user changes from one type of EFM to another type of EFM, as the case may be. Of course, as described, the use of detachable fasteners and/or fasteners that can be released and retightened also facilitate such rotational and/or positional adjustment.

The embodiments further enable attachment of a mounting ring to a structural surface (e.g., of a wall, ceiling, etc.) entirely from a 'front' side of the structural surface normally viewed by users, without any need to access a 'backside' thereof buried within the wall, ceiling, floor etc. Therefore, the installer need not cut an access hole through a structural surface in order to reach around to the other side during installation, which would then require repair or replacement, such as by a skilled craftsman. Installation is quick, clean, and relatively simple, requiring very few and commonly owned tools.

A system of ring cover/mounting ring designations enable relatively universal interchangeability of EFMs at an already installed mounting ring. Such universality provides greater flexibility and ease to users, preventing the need to engage a skilled craftsman simply to change the appearance or function of an EFM, and providing flexibility not present in the prior art. At the same time, each and every interchangeable EFM enjoys the secure mounting and high load bearing capacity of the mounting ring, and is not limited only to the load bearing capacity of a recessed fixture.

Unlike prior art devices, the invented embodiments include the ability to retrofit an existing recessed fixture with an EFM that is configured with and/or as an electrically operable device, wherein the EFM derives an operative electrical signal (e.g., power, media, data, etc.) from the recessed fixture. Alternatively, one or more embodiments are configured to likewise convey either of light or data, transmitted via an optical waveguide from a recessed fixture to an EFM.

In addition to the various advantages described, an ordinarily skilled artisan will recognize numerous others provided according to the very wide variety of contemplated embodiments.

Embodiments of the invention provide the ability to redirect at least a portion of the light of a recessed light fixture in a different and/or additional direction. For example, an optical waveguide may be bent, angled, split, or otherwise configured to dispense light in at least one direction other than the direction in which the recessed light fixture dispenses light. Alternatively, the light of a recessed light fixture may be reflected and/or refracted by either or both of mirrors (or other light reflecting structures) and prisms or lenses (or other light refracting structures) included at a portion of an EFM.

Likewise, light from a recessed light fixture can be passed through a filter of an EFM that blocks one or more portions of the electromagnetic spectrum (e.g., ultraviolet, infrared, one or more 'colors' of visible light, etc.), whether a single wavelength or band, or allows only a limited portion of the electromagnetic spectrum to pass therethrough, thus 'conditioning' the light from the recessed fixture before allowing it to pass beyond the EFM.

Therefore, one or more recessed light fixtures having lights that normally provide 'white' light can be temporarily transformed into colored lights (e.g., red, blue, green, etc.), or can provide a 'black light' effect, by coupling a light filter with each recessed light fixture according to the embodiments described herein. Alternatively, bleaching of materials can be reduced by excluding ultraviolet wavelengths, heat gain can be reduced by excluding infrared wavelengths, etc. A filter can likewise attenuate all frequencies of the visible light spectrum, providing a light dimming or light softening effect.

Alternatively and/or additionally; an EFM comprising a colored light fixture can obtain electrical power from a recessed light fixture, and the EFM may further include an electrically operable motor configured to enable rotation of the light. The motor may be controllable via a wired and/or wireless signal from a control panel or remote control device, enabling a user to conveniently and easily affect changes to an operational condition of the EFM.

Further, the presence of indexing features (e.g., indexing recess, indexing fastener, etc.) in an embodiment enables consistent and secure coupling of a ring cover with a corresponding mounting ring in a predetermined rotational orientation, and helps to prevent inadvertent decoupling.

As described, embodiments of the invention provide a previously unknown degree of flexibility to quickly and easily upgrade, enhance, or otherwise alter one or both of the appearance and function of a recessed fixture. Many further benefits not specifically mentioned herein will nevertheless be recognized by an ordinarily skilled artisan in view of the description, drawing figures, and/or claims presented herein.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims, and/or as otherwise consistent with the specification and accompanying drawing figures.

We claim:

1. An improved recessed fixture conversion apparatus, comprising:

a substantially planar mounting ring having a first side and an opposing second side, the mounting ring including:

a central opening disposed through a relative center of the mounting ring from the first side thereof to the second side thereof, and two or more first latch members disposed at the second side of the mounting ring beyond a periphery of the central opening and within an outer periphery of the mounting ring; and a ring cover having a first side and an opposing second side, the ring cover including:

a central opening disposed through a relative center of the ring cover from the first side thereof to the second side thereof;

a rim extending from the first side of the ring cover about an outer periphery of the ring cover, and two or more second latch members extending from the first side of the ring cover beyond a periphery of the central opening thereof and within the outer periphery thereof, wherein the two or more second latch members are arranged to couple with the two or more first latch members of the mounting ring via a twist-lock engagement.

2. The apparatus of claim 1, wherein the two or more second latch members extending from the first side of the ring cover comprise two or more second latch members extending from a latch member ring that is coupled at the first side of the ring cover.

3. The apparatus of claim 1, wherein a portion of each of the two or more second latch members extends in an approximately parallel planar relationship relative to and spaced apart from the first side of the ring cover.

4. The apparatus of claim 1, further comprising one or more slotted openings provided beyond a periphery of the central opening of the ring cover.

5. The apparatus of claim 1, further comprising:

an exposed fixture means coupled at the second side of the ring cover.

6. The apparatus of claim 1, wherein the respective central openings of the mounting ring and the ring cover substantially correspond in size with one another.

7. The apparatus of claim 1, further comprising:

a recess disposed at an edge of the mounting ring at the outer periphery thereof, wherein the recess includes an inclined side wall leading to a notch.

8. The apparatus of claim 7, further comprising:

an indexing fastener coupled with and extending through the rim, wherein the indexing fastener, when inserted through the rim, is configured to engage the recess and to urge the ring cover into an indexed position relative to the mounting ring.

9. The apparatus of claim 1, further comprising:

a conductive line having a first end extending beyond the first side of the ring cover and a second end extending beyond the second side of the ring cover, wherein the conductive line is configured to convey either or both of light and electricity from the first end of the conductive line to the second end thereof.

10. The apparatus of claim 9, wherein the conductive line is an optical waveguide, and wherein the first end of the optical waveguide is configured to convey beyond the second side of the ring cover light from a light source located beyond the first side of the ring cover.

11. The apparatus of claim 9, wherein the first end of the conductive line is configured to operably couple with an electrical source beyond the first side of the ring cover.

12. The apparatus of claim 5, wherein the exposed fixture means comprises a light re-directing device.

13. The apparatus of claim 5, wherein the exposed fixture means comprises a pendant fixture.

14. The apparatus of claim 9, wherein the exposed fixture means comprises a light emitting device.

15. The apparatus of claim 9, wherein the exposed fixture means comprises a motorized device.

16. A recessed fixture conversion system, comprising:

a mounting ring having a first side and an opposing second side, wherein plural receptacles are provided at the second side and within an outer periphery of the mounting ring;

a ring cover likewise having a first side and an opposing second side, and wherein plural tabs are provided at the second side and within an outer periphery of the ring cover, and wherein each of the plural tabs are configured to engage with a corresponding one of the plural receptacles when the mounting ring is nested within the ring cover and rotated relative thereto; and an exposed fixture means coupled at and extending from the second side of the ring cover.

17. The system of claim 16, further comprising:

a conductive line having a first end presented at the first side of the ring cover, and further having a second end operably coupled with the exposed fixture means.

18. The system of claim 16, further comprising:

an indexing recess provided at an outer edge of the mounting ring; and an indexing fastener extending from the ring cover and configured to engage the indexing recess.

19. The system of claim 16, wherein the exposed fixture means includes an electrically operable device.

20. The system of claim 16, wherein the exposed fixture means comprises a pendant fixture.

* * * * *